US005415068A

United States Patent [19]

Marzullo

[11] Patent Number: 5,415,068

[45] Date of Patent: May 16, 1995

[54] MULTI-FUNCTION ENVELOPE FEEDER

[75] Inventor: Joseph H. Marzullo, Brookfield, Conn.

[73] Assignee: Pitney Bowes Inc., Stamford, Conn.

[21] Appl. No.: 136,836

[22] Filed: Oct. 18, 1993

[51] Int. Cl.[6] ..... B65B 43/26

[52] U.S. Cl. ..... 53/492; 53/784.3; 53/381.5; 53/381.7; 271/2

[58] Field of Search ..... 271/2; 53/284.3, 381.1, 53/381.5, 381.7, 460, 492, 569

[56] References Cited

U.S. PATENT DOCUMENTS 2,668,053 2/1954 Bach ..... 53/381.7
4,715,164 12/1987 Lupert et al. ..... 53/381.7
4,813,209 3/1989 Foster et al. ..... 53/381.7
5,074,540 12/1991 Belec et al. .
5,074,544 12/1991 Kulpa et al. .
5,081,825 1/1992 Mrozinski .
5,168,689 12/1992 Macelis ..... 53/284.3
5,327,705 7/1994 DeFigueiredo ..... 53/381.7

*Primary Examiner*—W. Donald Bray
*Attorney, Agent, or Firm*—Ronald Reichman; Melvin J. Scolnick

[57] ABSTRACT

An envelope feeder in which a plurality of functions is performed. These functions are singulation, registration, flap opening, failure detection and envelope feeding of an envelope. The multi-function feeder can be operationally associated with a device that performs mail processing functions or printing operations.

9 Claims, 6 Drawing Sheets

MULTI-FUNCTION ENVELOPE FEEDER

BACKGROUND OF THE INVENTION

In the field of mail processing, commercially available apparatus are available that are capable of finishing mail. The finishing of mail can include inserting contents into an envelope, sealing the envelope, addressing the envelope and sorting the finished mail in accordance with the address on the address block. Examples of commercially available apparatus that process mail are inserters, such as the Model No. 8300 Series inserters available from Pitney Bowes Inc. Mail finishing systems are described in a number of patents including U.S. Pat. Nos. 5,119,306 and 5,142,482.

Although the primary functions have been achieved with regard mail processing equipment, there are other tasks that need to be performed to assure efficient mail processing. Among these are the opening of a flap on an envelope so that items can be inserted therein, registering the envelope so that it is in a position to receive contents, rejecting envelopes that are not properly registered or have not had their flaps open, and assuring that only one envelope at a time is fed. Although these functions can be performed in mail processing equipment, such equipment is complicated and expensive, so that it is not advantageous to perform the secondary functions with such equipment.

Clearly, it would be advantageous to assure that mail processing equipment receives envelopes that are properly registered, singulated and have their flaps open.

SUMMARY OF THE INVENTION

A feeding device has been conceived that performs functions that heretofore frequently had to be performed within mail processing equipment. The envelope feeder of the instant invention is capable of providing an envelope that is registered and with the flap opened to another apparatus such as a printer or a mail processing equipment. This is accomplished by having a magazine with envelopes therein adjacent to a belt that is driven by a bi-directional motor. An envelope is first driven from the magazine in a first direction and contacts a retard mechanism for the purpose of accomplishing singulation. Thereafter, the envelope is driven in the same direction until it comes in contact with a gate that performs the function of registration.

Upon registration being determined, the envelope is driven in the opposite, or second, direction and comes into contact with a plow that contacts the flap of the envelope to open the mouth thereof. A sensor then determines whether the flap has been opened successfully, and if so, the envelope continues in the second direction until it is advanced in a position so as to be fed to an accompanying apparatus. If the envelope flap has not been opened satisfactorily, the drive is reversed, the gate is lifted and the envelope is driven in the first direction and eventually ejected.

BRIEF DESCRIPTION OF THE DRAWINGS

In the drawing, wherein like numbers are used to designate like parts.

DETAILED DESCRIPTION OF THE PREFERRED EMBODIMENT

Figure 1:
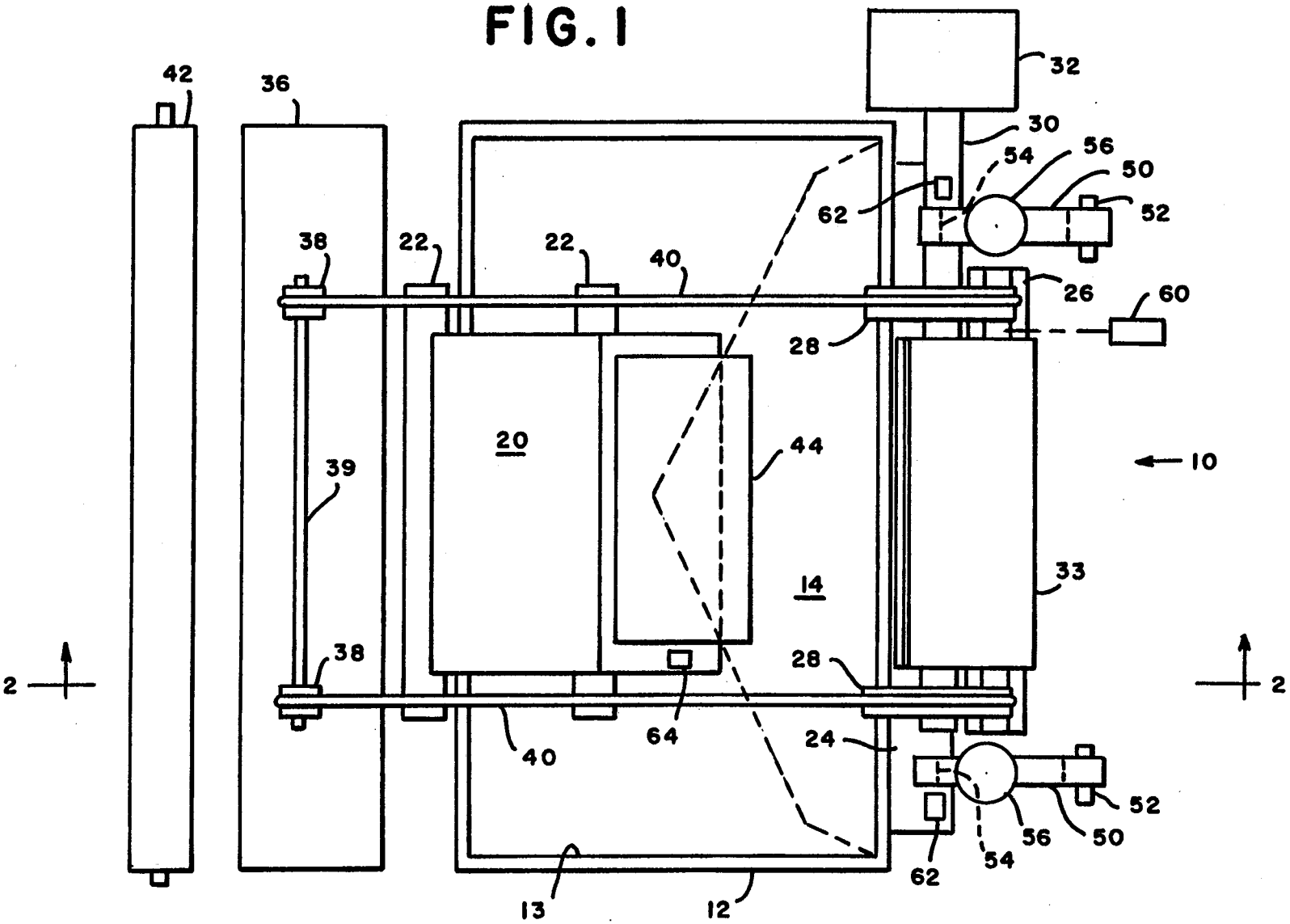
FIG. 1 is a plan view of an envelope feeding device that incorporates features of the invention.
Figure 2:
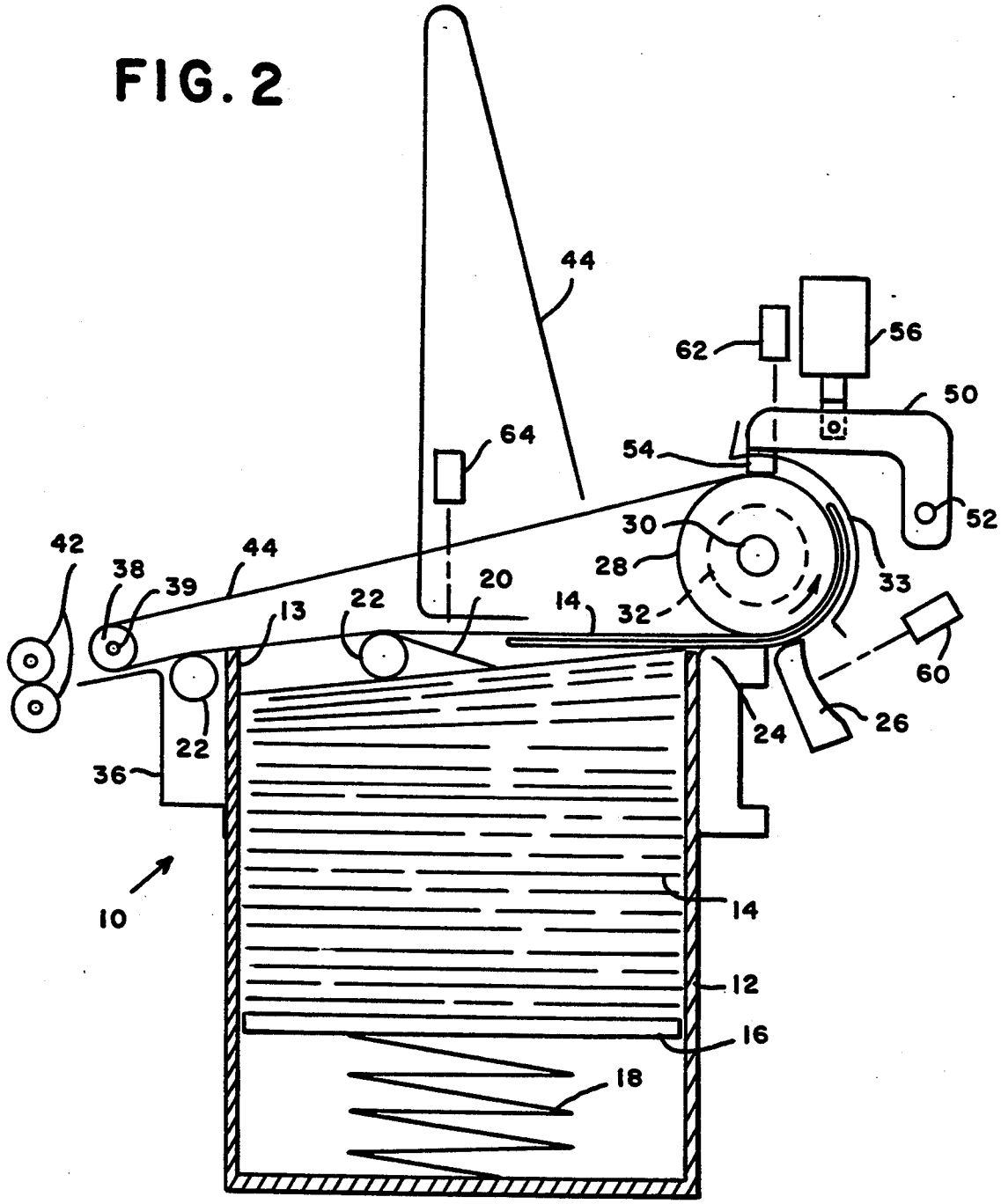
FIG. 2 is show a longitudinal cross sectional view of the device shown in FIG. 1 and taken substantially along the lines 2—2 during different stages of operation.

With reference to FIGS. 1 and 2, an envelope feeder is shown generally at 10 and has a magazine 12 that has an open end 13. A plurality of envelopes 14 are received within the magazine 12 and are engaged by a plate 16 that is biased in the direction of the open end 13. An expansion spring 18, or any other type of advance mechanism, is provided within the magazine for the purpose of biasing the plate 16 as shown.

A guide panel 20 is located at the open end 13 of the magazine 12 and is supported by a pair of shafts 22 that are secured to the magazine (by means not shown). Located in the area of the open end 13 of the magazine 12 is a retard member 24 for separating envelopes and adjacent to the retard member is a plow 26 for opening envelope flaps as will be described hereafter. Located above the retard member 24 and plow 26 are a pair of rollers 28 which are secured to a shaft 30 that is connected to a reversible motor 32. An arcuate guide plate 33 is located generally intermediate the rollers 28.

A bracket 36 is located and connected to the other side of the magazine 12 and located thereabove is a pair of idler rollers 38, each of which is in longitudinal alignment with one of the drive rollers 28 and support by a shaft, the shaft being supported by means not shown. A belt 40 is trained about each longitudinally aligned roller 28, 38 combination, the belts defining a path above the magazine 12. Adjacent to the idler rollers 38 are take away rollers 42. These take away rollers 42 could be part of an apparatus such as a mail processing apparatus for the purpose of receiving an envelope that is discharged from the feeder 10 as will be described hereinafter.

A deflector 44 is secured to the magazine 12 and serves the purpose of retaining envelopes 14 that are rejected as described hereinafter.

Located generally above the rollers 28 is a laterally extending, generally L-shaped cross sectional arm 50 that is pivotally supported by a laterally extending shaft 52. Supported at one end of the arm 50 is a gate 54. Attached to the arm 50 and supported in any convenient manner (not shown) is a solenoid 56. When the solenoid is not enabled, the gate 54 is located on the path in a blocking position relative to an envelope on the path. With the solenoid enabled, the gate 54 is removed from the path.

A first pair of lateral sensors 60 is located so as to direct light on the plow 26, a second pair of sensors 62 is located above the gate 54 and a third pair of sensors 64 is located above the guide panel 20. The sensors 60, 62, 64 can be supported in any convenient manner. The functions of these 60, 62, 64 optical sensors will be described hereinafter.

Figure 8:
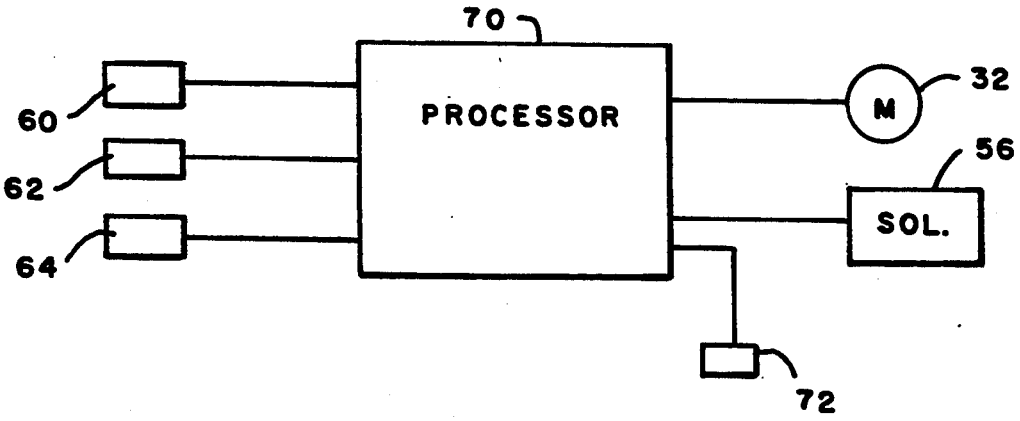
FIG. 8 is a block diagram of the circuit used to control the mechanism shown if FIGS. 1–8.
Figure 9:
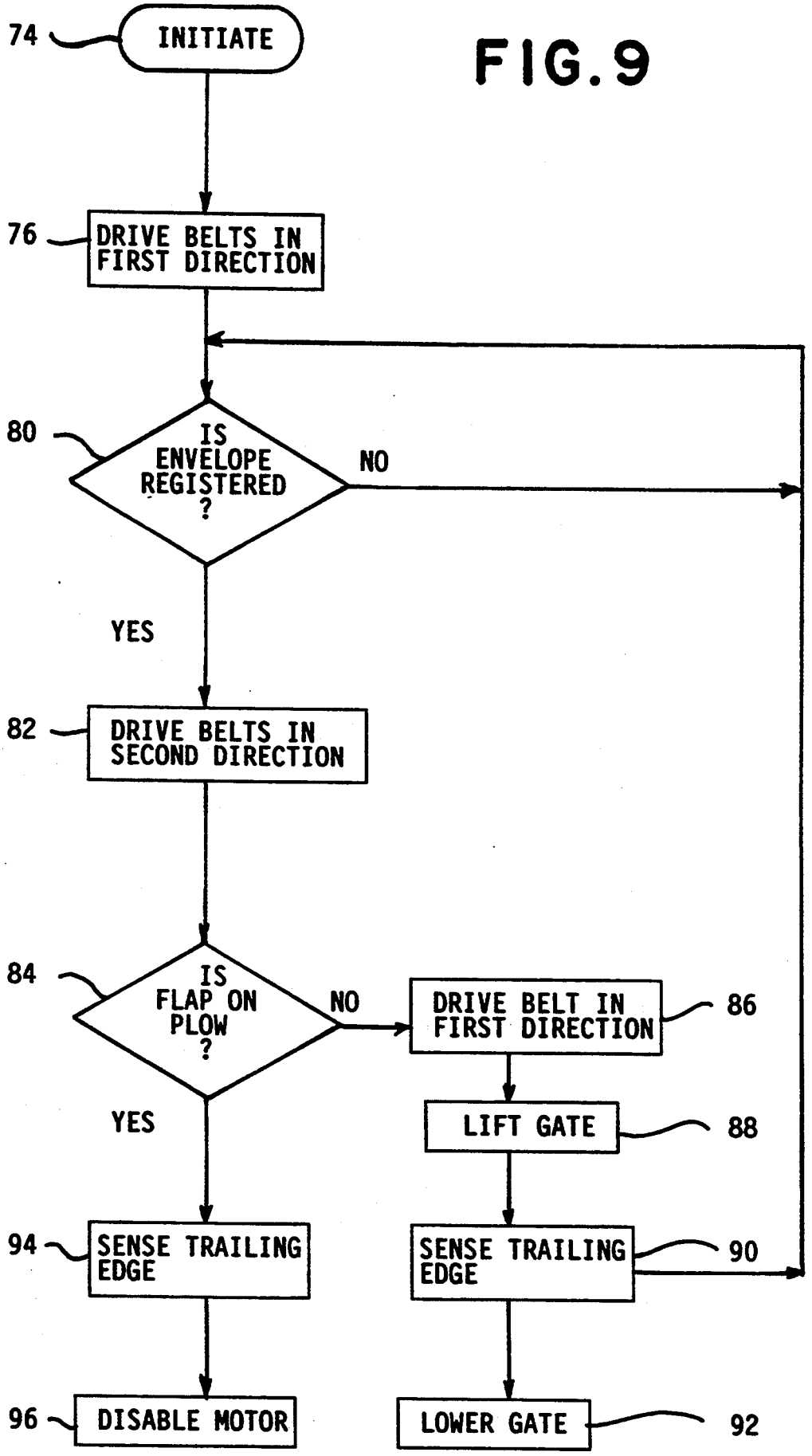
FIG. 9 is a flow chart representing the program for the device shown in FIGS. 1 and 2.

With reference to FIG. 8, the circuitry for controlling the operations of the envelope feeder shown in FIGS. 1–7 is shown. The circuitry includes a processor 70 which is programmed to carry out the appropriate tasks. The processor can be any of a number of commercially available microprocessors such as an Intel 80486. In electrical communication with the processor 70 are the motor 32, the solenoid 56 and the optical sensors 60, 62, 64. Also in communication with the processor 70 is a switch 72 that enables the device 10. The switch 72 can be actuated either manually or by command of the apparatus to which the take away rollers 42 are connected.

Figure 3:
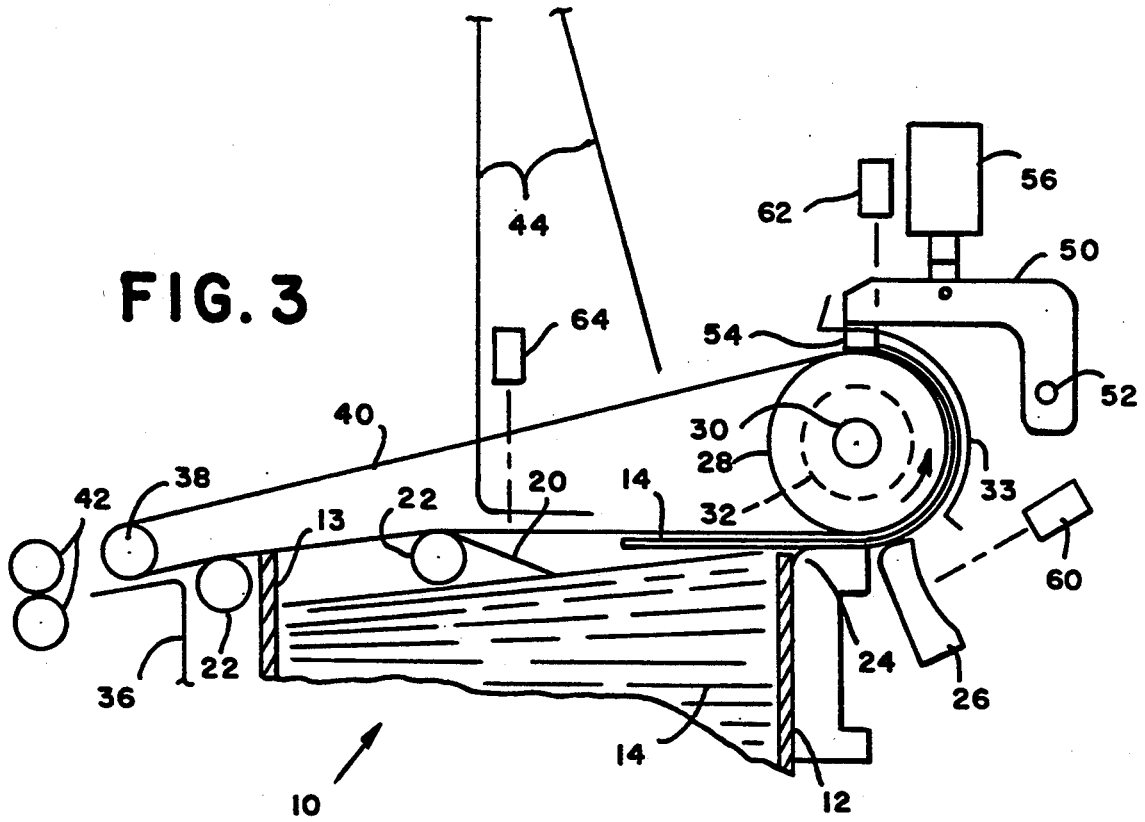
FIGS. 3–7 are views similar to FIG. 2 showing the device in different stages of operation.

With reference now to FIGS. 2–7 and 9 the operation of the device will now be described. When an envelope 14 is to be fed from the magazine 12, the motor 32 is enabled 74 by enabling the switch 72 so as to drive the belts 40 in the counter-clockwise direction. The upper most envelope 14 in the magazine 12 will be engaged by the belts 40 and driven over the retard member 24 as seen in FIG. 2. If more than one envelope 14 is removed from the magazine, the retard member 24 will contact the lower-most envelope and will act as a singulator to prevent more than one envelope from being conveyed by the belts 40. The envelope 14 that is conveyed by the belts 40 is then transported to a position as seen in FIG. 3 where it will contact the gate 54 that acts to register the envelope. Such registration occurs as the result of the driving force of the belts 40 acting on the envelope 14 while the gate 54 restrains the same.

Figure 4:
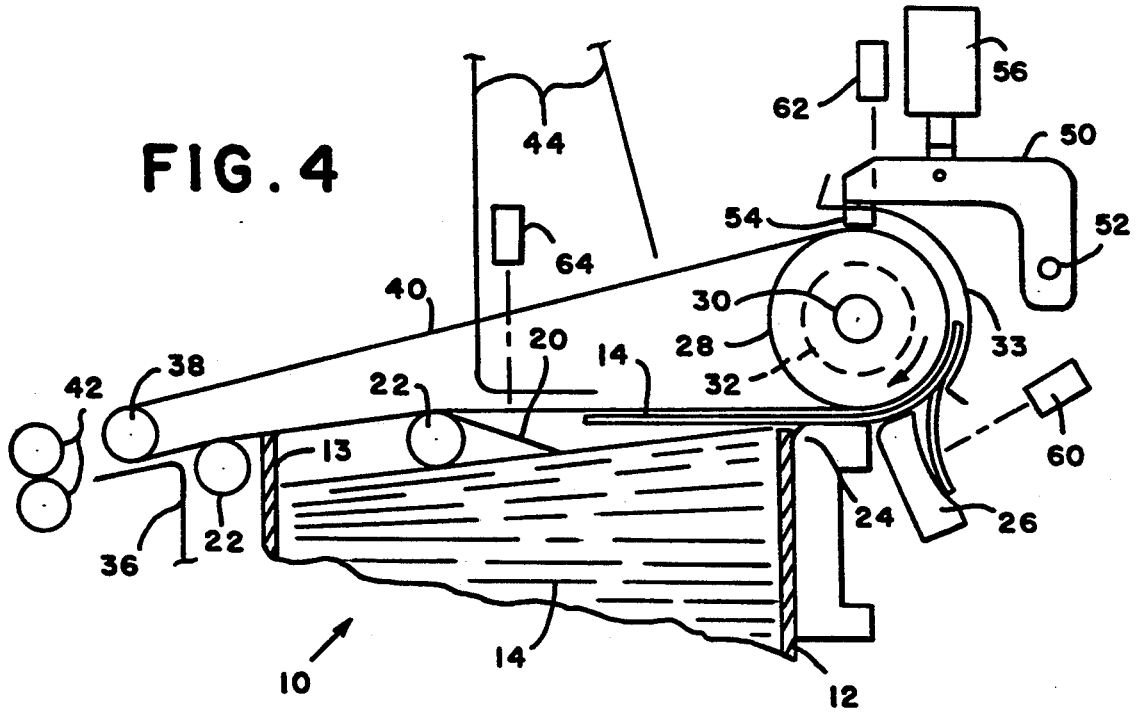
Figure 5:
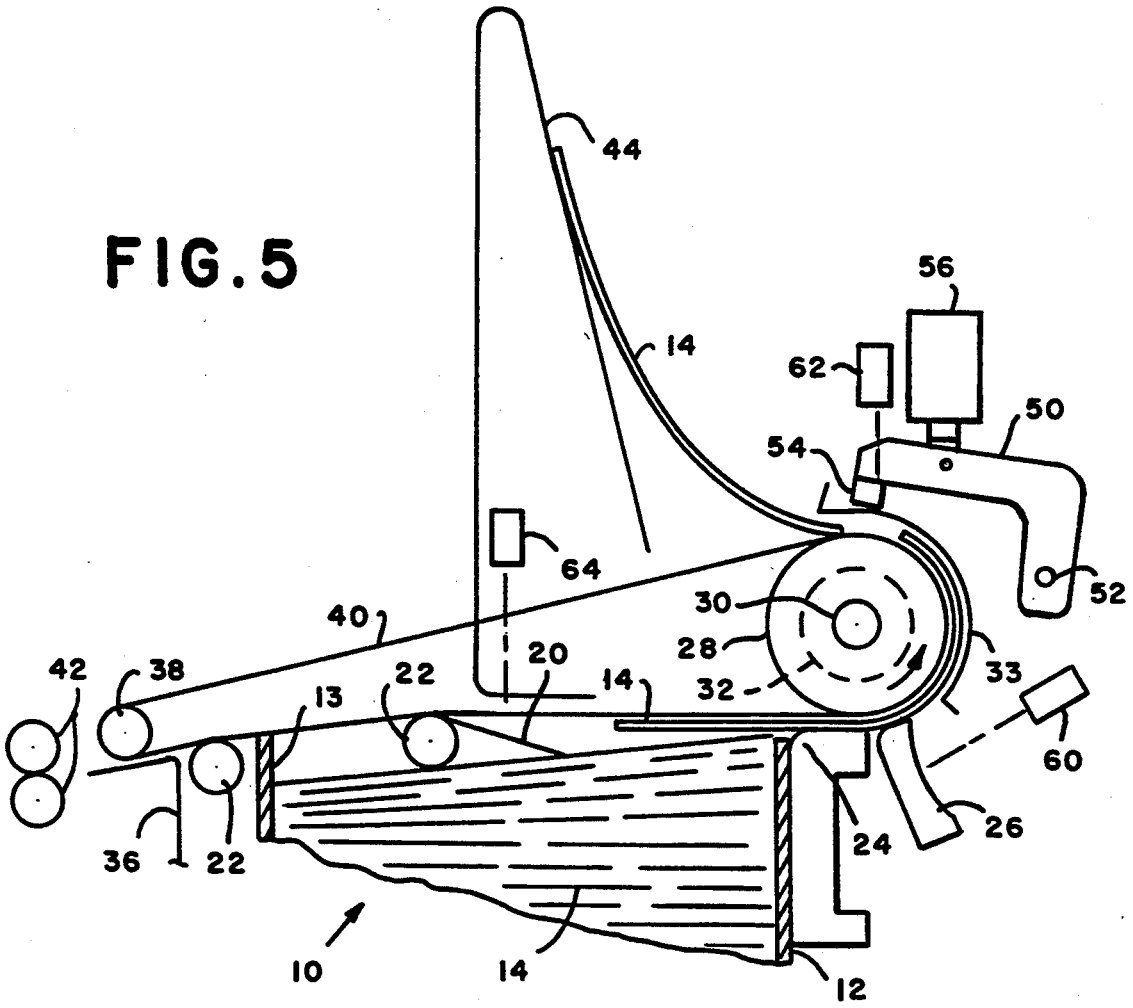

An inquiry is made to sensor 62 to determine whether the envelope is registered 80 (FIG. 9) against gate 54. If not, the drive continues. As soon as the optical sensors 62 sense that the entire edge of the envelope is in full engagement with the gate 54, the motor 32 will be reversed to drive the belt 40 in a clockwise direction 82 as seen in FIG. 4. Such engagement deskews the envelope 14 causing it to be subsequently presented to the plow 26 with the flap parallel to the leading edge of plow 26. This greatly enhances the reliability of flap opening. As the envelope 14 is driven in the clockwise direction, the flap of the envelope, 14 engages the plow 26 so as to be deflected thereby opening the envelope. As the envelope 14 continues to be conveyed in the second direction, the sensors 60 will determine in decision block 84 (FIG. 9) whether the flap on plow 26 will sense if the flap is on plow and if the flap is not sensed, i.e., the flap is now on plow a signal is sent to the processor which will cause the drive of the motor 32 to be reversed (Drive Belt In First Direction 86 FIG. 9) 86 so that the belts 40 are driven once more in the counterclockwise direction as seen in FIG. 5. With this occurring, the solenoid 56 will be enabled by the processor 70 to rotate the arm 50 about the pivot 88 thereby allowing the rejected envelope 14 to engage the deflector 44 and be ejected from the feeder 10. As this envelope is being driven toward ejection, a second envelope is driven by the belts 40 in the first direction. Upon the sensor 62 sensing the trailing edge 90 (FIG. 9*d*) of the first envelope, a signal will be sent to the processor 70 which will command the solenoid to release gate 54.

Figure 6:
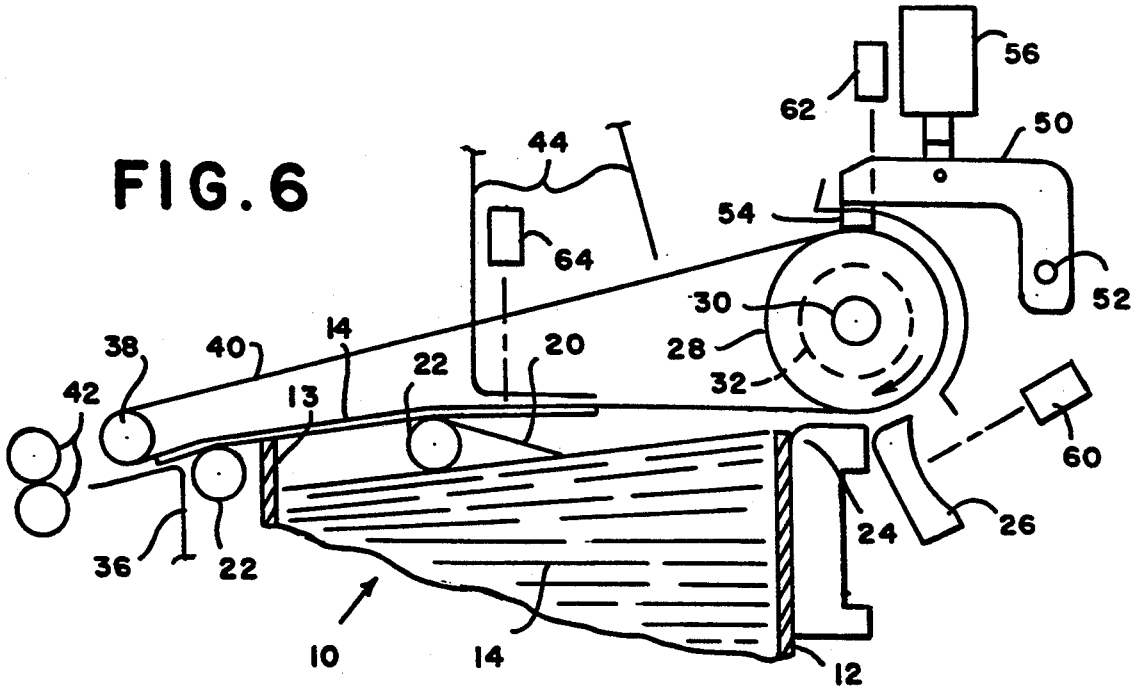
Figure 7:
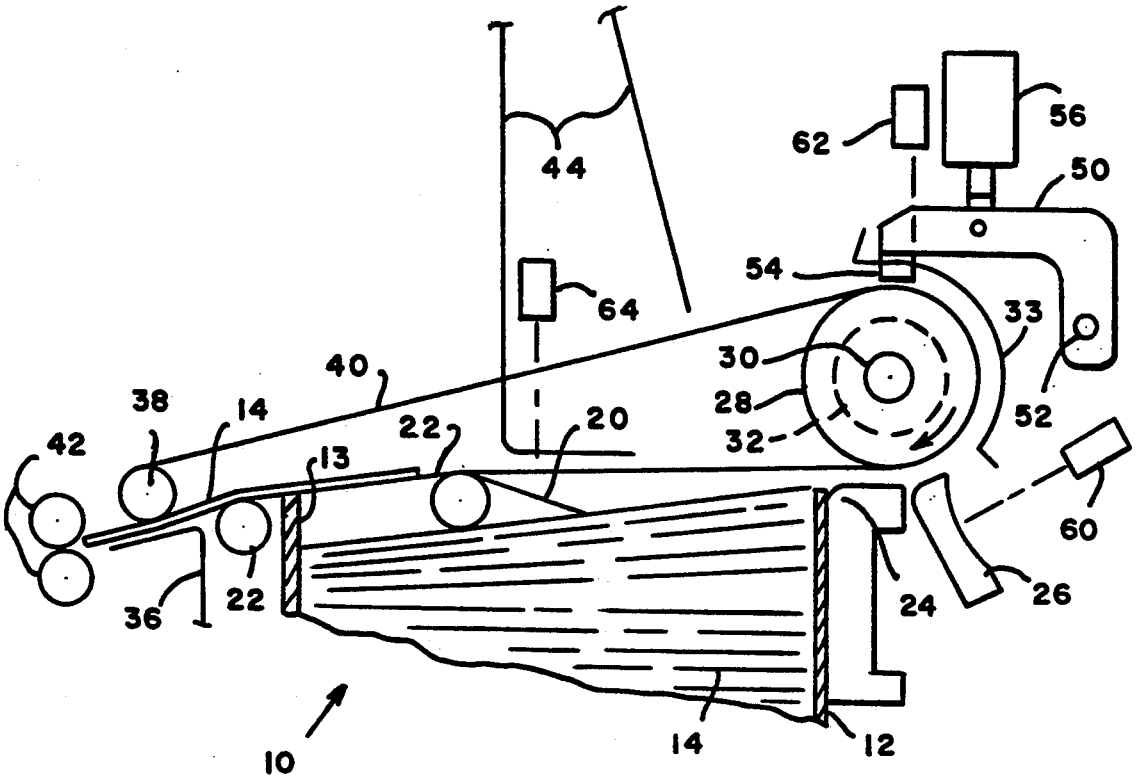

Assuming that the flap has been opened successfully, the motor 32 will continue to drive the belts 40 in the clockwise direction and the envelope 14 will pass the location of the sensors 64 as seen in FIG. 6. Upon the sensors 64 sensing the trailing edge 94 (FIG. 9) of the envelope 14, a signal will be sent to the processor 70 which will then cause the envelope 14 to be driven to a position shown in FIG. 7, then the processor 70 will stop motor 32 (disable motor 96 FIG. 9) with a portion of the envelope 14 extending beyond the belts adjacent to the nip of the take-up rollers 42 until such time as the mechanism to which the envelope feeder is feeding the envelopes is prepared to receive the same. A singulated and flap opened envelope 14 is present, ready for subsequent process on demand. Upon the take-up rollers 42 removing an envelope from the feeder, the process is repeated as described above.

Thus, what has been shown and described is an envelope feeder that serves the functions of singulating, registration, flap opening, rejection, and feeding an appropriate device.

The above embodiments have been given by way of illustration only, and other embodiments of the instant invention will be apparent to those skilled in the art from consideration of the detailed description. Accordingly, limitations on the instant invention are to be found only in the claims.

What is claimed is:

1. A multi-function envelope feeder comprising:

a) a magazine for storing a plurality of envelopes, b) at least one belt located adjacent to and in contact with said magazine, and defining a path, c) first drive means for driving said at least one belt in a first direction, d) means for urging an envelope from said magazine into contact with said at least one belt, e) a movable gate located on said path, f) means for moving said movable gate adjacent to said path in a blocking position with an envelope thereon and away from said path, g) said first driving means driving an envelope on said path against said movable gate, h) first sensing means for sensing the presence of an envelope against said removable gate, i) said first means in communication with first sensing means for driving said belt in a second direction, j) a plow located on said path for engagement with the flap of an envelope being conveyed by said belt in said second direction, k) second sensing means in communication with said first and second driving means for sensing an open flap as an envelope is conveyed by said belt in said second direction, l) means in communication with said second sensing means for disabling said second driving means and enabling said first driving means upon a flap not being sensed by said second sensing means, m) third sensing means for sensing an envelope at a selected location along the path when a flap is not sensed, and n) means in communication with said third sensing means for removing said movable gate from said path upon an envelope not being sensed by said third sensing means, for disabling said motor upon said third sensing means sensing an envelope.

2. The multi-function envelope feeder of claim 1 wherein said movable gate includes a rotatable arm a gate depending from said rotatable arm and a solenoid attached to said rotatable arm for rotating said arm in response to said second sensor means not sensing an envelope flap and further comprising a deflector located downstream when said at least one belt is driven in said first direction for receiving envelopes.

3. The multi-function envelope feeder of claim 1 further including said magazine having biasing means for biasing a stack of envelopes toward said at least one belt.

4. The multi-functional envelope feeder of claim 1 further including means for disabling said second driving means upon said third sensing means sensing an envelope.

5. The multi-function envelope feeder of claim 1 further including a retard member located adjacent to said path and downstream from said magazine when said at least one belt is driven in said first direction.

6. A multi-function envelope feeder comprising:

a) a processor b) a magazine for storing a plurality of envelopes, c) a pair of longitudinally extending, laterally spaced belts located adjacent to and in operational contact with said magazine and defining a path, d) a reversible motor in communication with said processor and in driving engagement with said pair of belts to drive said pair of belts in a first direction and a second direction, e) a movable gate located along the path downstream from said magazine when said pair of belts is driven in the first direction, f) a retarding member located on said path intermediate said magazine and said movable gate, g) biasing means for urging an envelope from said magazine toward said pair of belts when said pair of belts is driven by said reversible motor in the first direction, h) first sensing means in communication with said processor for sensing the presence of an envelope in contact with said gate and being responsive to signal said processor upon sensing an envelope in engagement with said gate to cause said processor to reverse the drive of said motor thereby causing said motor to drive said belts in the second direction, i) a plow located on said path intermediate said retarding member and said gate for engagement with the flap of an envelope upon the envelope being conveyed by said belts in the second direction, j) second sensing means in communication with said processor for sensing an open flap on said plow as an envelope is conveyed by said belts in said second direction, k) said processor being operative to send a signal to said motor for reversing the drive of said motor upon a flap not being sensed by said second sensing means to drive said belts in the first direction, and l) third sensor means in communication with said processor for sensing an envelope at a selected location along the path intermediate said retarding member and said magazine to cause said processor to disable said motor upon said third sensing means sensing the presence of an envelope.

7. The multi-function envelope feeder of claim 1 wherein said biasing means for urging an envelope comprises a plate received within said magazine and an expansion spring located intermediate said plate and said magazine to bias said plate toward said pair of belts.

8. A method of feeding an envelope, the steps comprising:

a) storing a plurality of envelopes in a magazine, b) driving an envelope from said magazine along a path in a first direction, c) driving the envelope across a retarding member, d) driving the envelope against a removable gate on the path, e) sensing the presence of an envelope in full engagement with the gate, f) driving the envelope in a second direction upon sensing the envelope in full engagement with the gate, g) opening the flap of an envelope as it is conveyed in said second direction, h) seeking an open flap as the envelope is conveyed in said second direction, i) reversing the drive of the envelope to the first direction upon a flap not being sensed, j) continuing driving the envelope in the second direction upon the flap being sensed, k) seeking the presence of the envelope at a selected location along the path, and l) disabling the drive of the envelope upon sensing of the envelope at the selected location along the path.

9. The method of claim 8 further including the step of lifting the gate away from the path upon an envelope not being sensed in step k).

* * * * *